US005255646A

United States Patent [19]

Inagaki et al.

[11] Patent Number: 5,255,646

[45] Date of Patent: Oct. 26, 1993

[54] TORQUE FLUCTUATION ABSORBING DEVICE FOR AN ENGINE

[75] Inventors: Mitsuo Inagaki; Mikio Matsuda; Hiroki Ishii, all of Okazaki, Japan

[73] Assignee: Nippondenso Co., Ltd., Kariya, Japan

[21] Appl. No.: 974,938

[22] Filed: Nov. 12, 1992

[30] Foreign Application Priority Data

Nov. 15, 1991 [JP] Japan ..... 3-300497

[51] Int. Cl.[5] ..... F02B 75/06

[52] U.S. Cl. ..... 123/192.1

[58] Field of Search ..... 123/192.1

[56] References Cited

U.S. PATENT DOCUMENTS 5,105,776 4/1992 Tsuchiya et al. ..... 123/192.1

FOREIGN PATENT DOCUMENTS 232890 9/1990 Japan .

397387 8/1993 United Kingdom ..... 123/192.1

*Primary Examiner*—Noah P. Kamen

*Attorney, Agent, or Firm*—Cushman, Darby & Cushman

[57] ABSTRACT

A torque fluctuation absorbing device for an engine constituted so that a rotation shaft of a torque absorber constituted so that torque fluctuations are generated by the force of a spring and pressure of fluid during rotation, is connected to a crank shaft of an engine using a rotation transmitting means which can maintain and transmit a constant synchronous relationship, such as a toothed pulley and a toothed belt, and the torque fluctuations of both of the engine and torque absorber are set to be opposite in phase to each other so as to offset the torque fluctuations of the engine.

15 Claims, 6 Drawing Sheets

TORQUE FLUCTUATION ABSORBING DEVICE FOR AN ENGINE

BACKGROUND OF THE INVENTION

1. Field of the Invention

The present invention relates to a torque fluctuation absorbing device for an engine which is attached to, for example, an engine mounted on a car, for absorbing torque fluctuations of a crank shaft.

2. Description of the Related Art

It is well known that, at a crank shaft of a four-cycle engine mounted on a car, considerably large torque fluctuations can occur at low-speed rotation such as the idling state, which may cause unpleasant vibrations in a car body and impair riding comfort. When, for example, the idling speed of an engine is lowered with the purpose of improving fuel cost performance, it is difficult to fully prevent rolling vibrations caused by torque fluctuations in a conventional engine.

As one of the measures against this problem, there is considered a method that a moment of force is generated between an engine block and a crank shaft by an electromagnetic action, but such a mechanism causes other problems that extremely complicate the structure of the engine and its weight is remarkably increased, therefore, the method has not been put to practical use yet.

Also, in Japanese Examined U.M. Publication No. 2-32890, a device is disclosed in which an additional mass body is provided inside a clutch in addition to a main flywheel and the mass body is engaged with a crank shaft of an engine by an auxiliary clutch interlocking with a main clutch, but with a torque fluctuation absorbing device for an engine using inertial force of the mass body, it is difficult to fully absorb large torque fluctuations at idling speed unless a flywheel with an extremely large inertial moment is used.

Moreover, in another conventional example, one or several balance shafts with an unbalanced weight attached are provided in parallel with a crank shaft, but the physical size and the structure of the engine must be increased and becomes extremely complicated, and a vibration isolation effect is not gained depending on the engine speed.

SUMMARY OF THE INVENTION

In view of the aforementioned problems of the prior art, the object of the present invention is to provide a torque fluctuation absorbing device for an engine which can surely absorb large torque fluctuations generated in a state such as idling, with a simple constitution.

Another object of the present invention is to provide a torque fluctuation absorbing device for an engine which can prevent rolling vibrations in a car on which an engine is mounted so as to improve riding comfort of the car.

Another object of the present invention is to, provide a torque fluctuation absorbing device for an engine which can reduce fuel consumption at idling speed by enabling lowering of the idling speed of the engine.

Another object of the present invention is to provide a torque fluctuation absorbing device for an engine which stops working when torque fluctuations are small so that electric power is not wasted and durability is not diminished.

Still another object of the present invention is to provide a torque fluctuation absorbing device for an engine which can be operated according to the speed of an engine.

Other objects of the present invention will be obvious to those skilled in the art by referring to the following detailed description.

According to the present invention, in order to achieve the above objects, there is provided a torque fluctuation absorbing device for an engine provided with a torque absorber attached to an engine for generating torque fluctuations, and a rotation transmitting means for transmitting rotation of a crank shaft of the engine to a rotation shaft of the torque absorber without changing the synchronous relationship, wherein the crank shaft and the rotation shaft of the torque absorber are connected to each other by the rotation transmitting means so that torque fluctuations of a phase opposite to those of the torque fluctuations generated at the crank shaft are generated.

For example, at a crank shaft of a four-cycle engine having N cylinders, torque fluctuations occur N times during two rotations, and when the crank shaft is connected to a rotation shaft of a torque absorber constituted so that one cycle of torque fluctuation is generated for one rotation through a rotation transmitting means for outputting N/2 rotations per rotation of the crank shaft, so that torque fluctuations of the crank shaft are offset by the torque fluctuations of the torque absorber which are opposite in phase and smooth rotation can be obtained from the crank shaft of the engine. As a result, rolling vibrations at the engine itself, and in a car body in the case of a car, conventionally generated as a reaction to the torque fluctuations of the crank shaft, can be prevented and riding comfort of the car can be improved.

DESCRIPTION OF THE PREFERRED EMBODIMENTS

Figure 1:
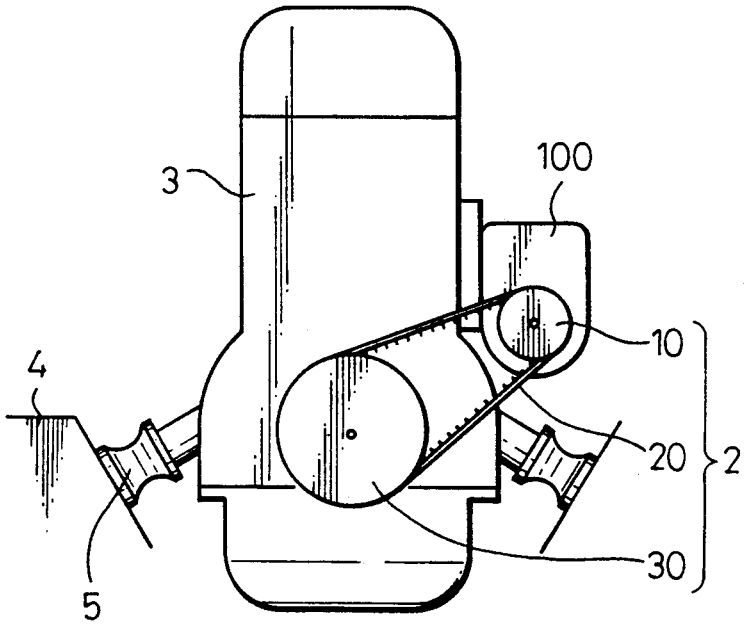
FIG. 1 is a front view illustrating the schematic structure of an engine provided with a torque fluctuation absorbing device according to the present invention.

FIG. 1 shows the schematic constitution of a preferred embodiment of a torque fluctuation absorbing device for an engine according to the present invention. In this Fig., the reference number 100 indicates a torque absorber attached to an engine block of a four-cycle engine 3 with four cylinders with a bolt, not shown. The torque absorber 100 and the engine 3 are connected to each other by a rotation transmitting means 2 consisting of an absorber pulley 10 of the torque absorber 100, a crank pulley 30 of the engine 3 and a toothed belt 20 passed around the pulleys. This preferred embodiment is so constituted that the torque absorber pulley 10 rotates twice when the crank pulley 30 rotates once by setting the ratio of the number of teeth of the crank pulley 30 to the number of teeth of the torque absorber pulley 10 to 2:1.

The reference number 4 in this Fig. indicates a body of a car and 5 is a mount for supporting the engine 3 on the body 4.

Figure 2:
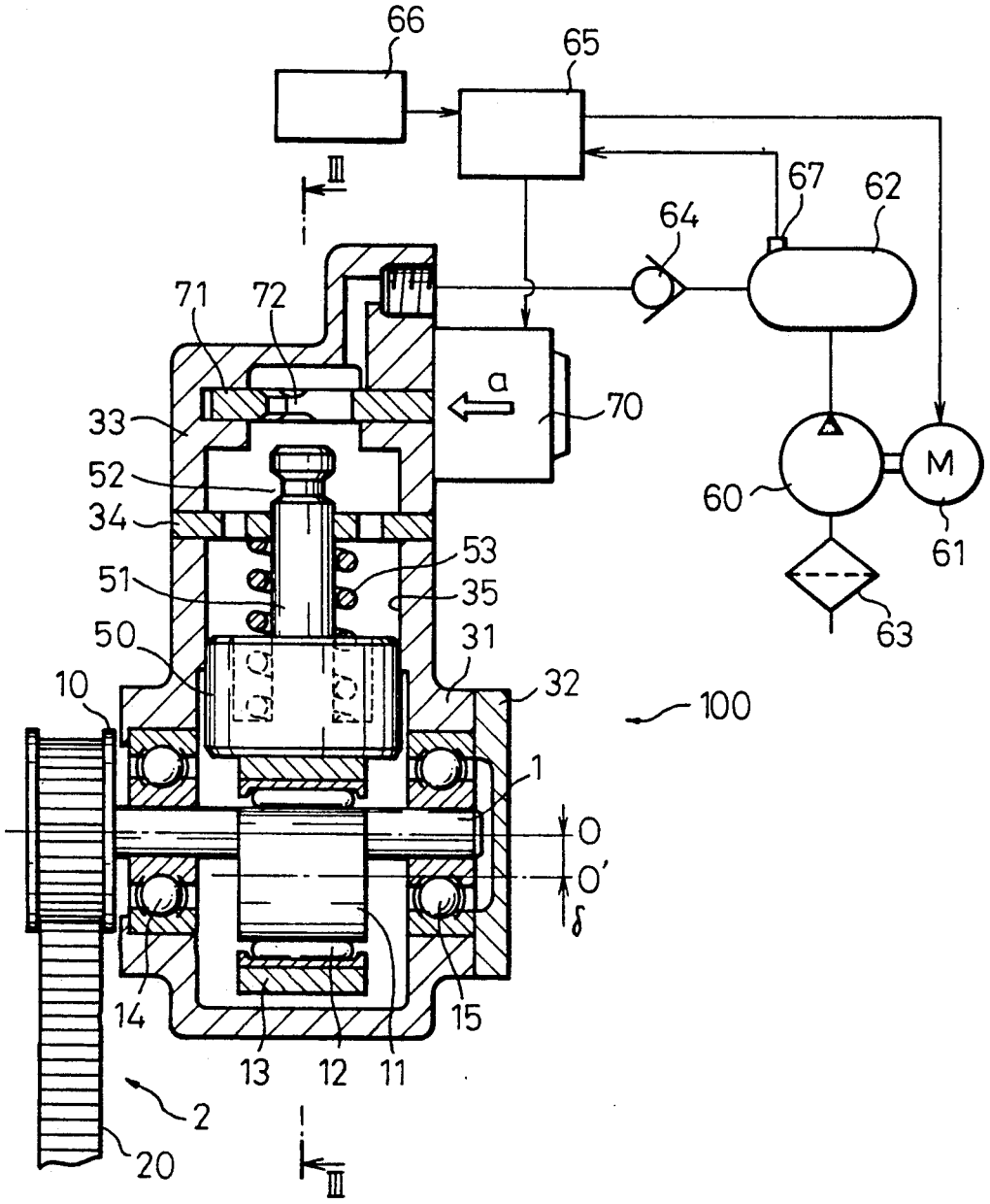
FIG. 2 is a vertical sectional front view illustrating a preferred embodiment of a torque absorber, which is an essential part of a torque fluctuation absorbing device according to the present invention.
Figure 3:
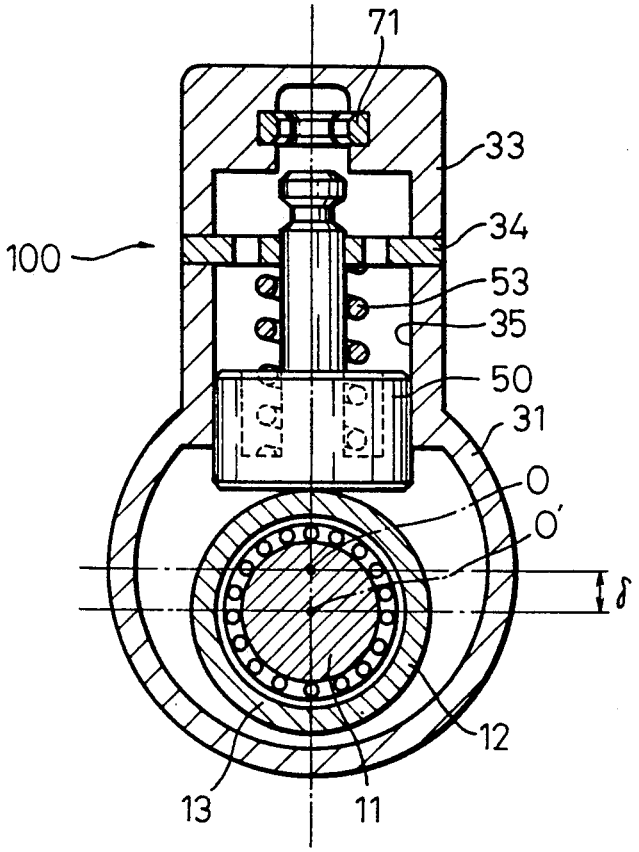
FIG. 3 is a vertical sectional side view of the torque absorber in FIG. 2 taken along a line III—III.
Figure 4:
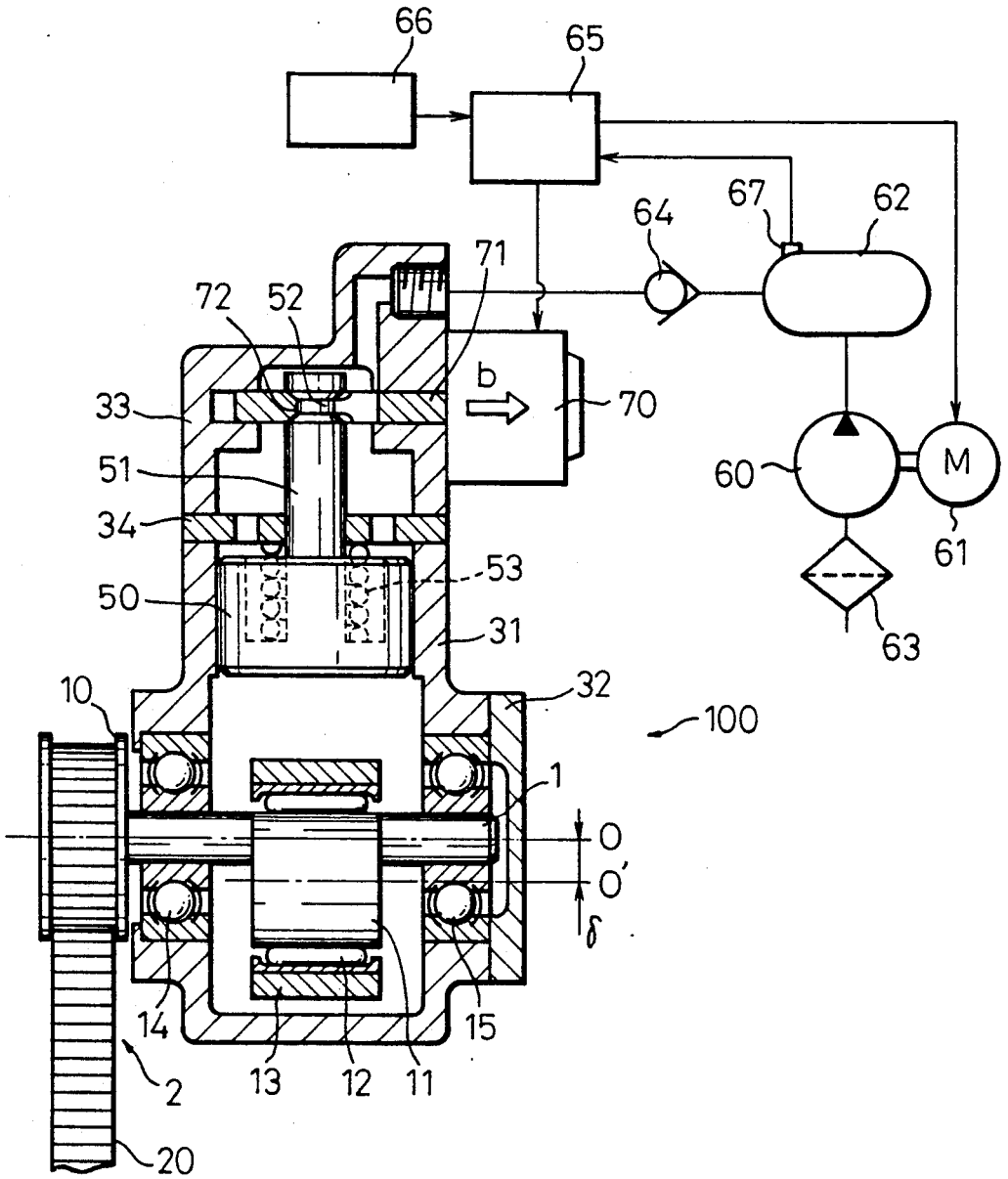
FIG. 4 is a vertical sectional front view showing a working state of the torque absorber in FIG. 2, different from FIG. 2 and FIG. 3.

The constitution of the torque absorber 100 in the torque fluctuation absorbing device for an engine according to the present invention will be illustrated concretely with reference to FIG. 2, FIG. 3 and FIG. 4.

In these FIGS., 31 is a housing which supports a rotation shaft 1 through bearings 14 and 15 and incorporates a piston 50 capable of a reciprocating motion by providing a cylinder part 35. The rotation shaft 1 has a crank mechanism provided with a crank part 11, which is a cylinder portion having its center at 0' offset against the rotation center 0 by δ, and has the torque absorber pulley 10 fixed with a bolt and so on, not shown. An annulus ring 13 is rotatably engaged with the crank part 11 through a bearing 12.

The piston 50, with a rod part 51, is inserted into the cylinder part 35 provided at the housing 31 with a micro clearance therebetween, is capable of reciprocal motion in a sliding manner. The rod part is guided by a hole in a spacer 34 fixed between a housing cover 33 and the housing 31, and a small-diameter groove part 52 is provided at the tip of this rod part 51. Also, this piston 50 is pressed to the annulus ring 13 by receiving a force from an energized spring 53 one end of which is supported by the spacer 34 and the other end of which is supported by the piston 50 and pressure from compressed air, which will be described later, and constitutes a load generating part acting on the crank part 11 of the rotation shaft 1.

70 is a solenoid mounted on the housing cover 33 and incorporated so that a hook 71 can be moved in the direction of an arrow a in FIG. 2, when electric current flows from a control circuit, which will be described later. This hook 71 has a hole part 72 which can enter the small-diameter groove part 52 of the piston 50 and which constitutes a piston engaging means in cooperation with the small-diameter groove part 52 of the piston. When the electric current in the solenoid 70 is cut off, the hook 71 is moved in the direction of an arrow b in FIG. 4 so that the small-diameter groove part 52 of the piston 50 can be engaged with the hole part 72 of the hook 71.

Moreover, the torque absorber 100 according to this preferred embodiment is connected to a compressed air supplying means by pressure piping. 60 is an air compressor for receiving rotation of an electric motor 61 and compressing air. 63 is a filter provided on the intake side of the air compressor 60, 62 is an accumulator provided at the discharge side for accumulating compressed air, and 64 is a check valve for allowing a supply of compressed air from the accumulator 62 to a cylinder chamber of the torque absorber 100. And in order to control the solenoid 70 and the electric motor 61 and so on, a control circuit 65 is connected thereto as shown in FIG. 2. The control circuit 65 is connected to an engine speed detecting circuit 66, a pressure sensor 67 attached to the accumulator 62, and so on, so as to receive signals therefrom.

In the torque fluctuation absorbing device for an engine in this preferred embodiment, the ratio of the number of teeth of the crank pulley 30 mounted on the crank shaft of the four-cycle engine 3 with four cylinders to the number of teeth of the torque absorber pulley 10 mounted on the rotation shaft 1 of the torque absorber 100 is set at 2:1. The pulleys 10 and 30 are connected to each other with the toothed belt 20 so as to constitute the rotation transmitting means 2. Thus, the torque absorber 100 rotates twice while the engine 3 rotates once, and the synchronous relationship of these rotations is kept constant all the time regardless of changes in the engine speed.

Figure 5:
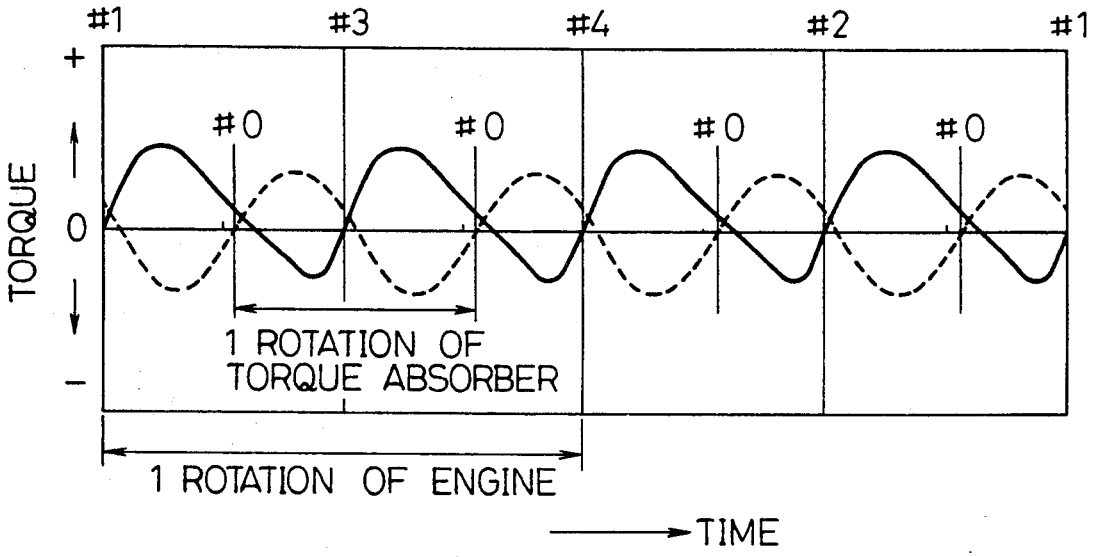
FIG. 5 is a diagram explaining the working principle of the present invention.

With four-cycle engines in general, four strokes of intake—compression—combustion—exhaust per cylinder take place while an engine rotates twice, with a load being received from outside in the compression stroke, and power applied to outside in the combustion stroke. In this way, on the crank shaft of the engine, torque is applied in a direction opposite to the rotation direction in the compression stroke, and torque is applied in the forward direction of the rotation direction of the engine in the combustion stroke. Thus, in a four-cycle engine with four cylinders, in general, as shown by a solid line in FIG. 5 two cycles of almost sinusoidal large torque fluctuation are generated for one engine rotation. And this torque fluctuation applies a force to the cylinder block of the engine 3, which generates a rolling vibration in the engine. This vibration is further transmitted to the body 4 through the mount 5, which causes vibrations in the vehicle and impairs comfort.

This phenomenon occurs particularly in the idling state where the engine speed is low. This is because, as a cycle time of torque fluctuations is shortened and the fundamental frequency of the fluctuations is raised with an increase in rotation speed, transmission of vibrations to the body 4 is inhibited by the mount 5 having elasticity, and by the inertial force of a flywheel of the engine.

In the illustrated preferred embodiment of the present invention, the torque fluctuations of the engine 3 and the torque absorber 100 are offset from each other by connecting the crank shaft of the engine 3 to the absorber 100 by the rotation transmitting means 2 using the toothed belt 20 so that, for two cycles of torque fluctuation per engine rotation generated at low speed of the four-cycle engine with four cylinders, the torque absorber 100 for generating one cycle of torque fluctuation per rotation makes two rotations per engine rotation, and, at this time, by setting the timing so that these torque fluctuations are opposite in phase to each other.

To explain in more detail, the torque absorber 100 has the cylinder 35 and the piston 50 which engages with the cylinder 35 slidably in the reciprocating direction. And, the annulus ring 13 is rotatably engaged through the bearing 12 with the crank part 11 provided integrally with the rotation shaft 1 and turning at the position which is offset against the rotation shaft 1 by δ, and the above piston 50 is pressed to the annulus ring 13. As the annulus ring 13 itself has only a revolving motion, having its rotation component absorbed by the bearing 12, the piston 50 guided and regulated by the annulus ring 13 has a sinusoidal reciprocating motion.

As high pressure from the compressed air supplying means and an almost constant load due to the spring 53 working against this piston 50 constantly, the piston 50 becomes the load generating part against the rotation shaft crank part 11. Therefore, on the torque absorber pulley 10 for rotating the rotation shaft 1, torque is applied in the opposite direction to the rotation direction as the piston 50 rises and in the rotation direction as the piston 50 lowers, and one cycle of almost sinusoidal torque fluctuation is generated per rotation.

Thus, toothed pulleys and a toothed belt are used in this preferred embodiment so that the rotation transmitting means 2 can surely synchronize the rotation of the engine 3 with the rotation of the torque absorber 100. As synchronization of actual rotations is set so that the torque fluctuations of the engine shown by the solid line in FIG. 5 and opposite in phase to the torque fluctuations of the torque absorber 100 shown by the broken line, rotation positions of the pulleys 10 and 30 are determined so that top dead center #0 of the piston 50 of the torque absorber 100 comes at a position of a little more than a ¼ rotation of the engine from top dead center of each of the pistons (#1, #3, #4, #2) the engine 3, not shown, whereby the torque fluctuations of the engine 3 are offset by the torque fluctuations of the torque absorber 100.

The compressed air supplying means in this preferred embodiment sucks air through a filter 63 when the air compressor 60 is driven by an electric current in the electric motor 61 controlled by a command from the control circuit 65, and compresses and sends the air out to the accumulator 62. The compressed air is led by the pressure piping to the cylinder chamber formed in the housing 31 of the torque absorber 100, and a space in the housing cover 33 through the check valve 64. The control circuit 65 receives a signal from a pressure sensor mounted on the accumulator 62 and causes electric current to flow in the electric motor 61 only when the pressure is less than a set value, which prevents the electric motor 61 from wasting power.

Also, the control circuit 65 controls electric current in the solenoid 70. When electric current does not flow in the solenoid 70, the hook 71 is moved in the direction of the arrow b as in FIG. 4. As mentioned above, the hook 71 has the hole part 72 which can be engaged with the small-diameter groove part 52 formed at the tip end of the rod part 51 of the piston 50, and engagement of this piston engaging means stops the reciprocating motion of the piston 50 at its top dead center. In this way, the torque absorber 100 no longer generates torque fluctuations for the rotation shaft 1, but maintains the idle rotating state. This state is generated when the control circuit 65 detects that the speed of the engine 3 exceeds a predetermined value by a signal from the engine speed detecting circuit 66, and electric current in the solenoid is cut off.

When the speed of the engine 3 is lowered below the predetermined value, the control circuit 65 allows electric current to flow in the solenoid 70. At this time, as the hook 71 is moved in the direction shown by the arrow a in FIG. 2 and the hole part 72 formed at the hook 71 is separated from the small-diameter groove part 52 of the piston 50, the piston 50 is brought into contact with the annulus ring 13 which makes a revolving motion with rotation of the crank part 11 formed at the rotation shaft 1, and torque fluctuations are generated at the rotation shaft 1.

As is obvious from the above explanation, though the torque fluctuation absorbing device for an engine according to this preferred embodiment of the present invention has an extremely simple constitution and is a device that is small in size and light in weight, it can reduce rolling vibration of an engine by connecting the absorber pulley 10 of the torque absorber 100 having one cycle of torque fluctuation per rotation to the crank pulley 30 of the four-cycle engine 3 with four cylinders through the rotation transmitting means 2 to interlock them with each other while maintaining the constant synchronous relation with the speed ratio of 2:1 so as to offset the torque fluctuations of the engine 3 by the torque fluctuations of the torque absorber 100, which greatly contributes to reduction in vibration of the vehicle and improvement in comfort. And, with this effect, the idling speed of the engine can also be lowered, which enables a drastic reduction in fuel consumption in the idling state.

In addition, with the torque fluctuation absorbing device for engine according to this preferred embodiment of the present invention, as there is provided the engaging means of the piston 50 which can stop operation of the torque absorber 100 so that it can be brought into the idle rotating state during high speed rotation of the engine 3, durability of the torque absorber 100 itself can be substantially improved. And, as the air compressor 60 used as a high pressure source working on the piston 50 at the load generating part engaged with the crank part of the rotation shaft 1 of the torque absorber 100 is driven by the electric motor 61 so that electric current can be controlled, excess power consumption can be prevented.

As an illustrated preferred embodiment of the present invention, a device is shown in which a spring force and pressure by compressed air are both used as an energizing force on the piston 50 as the load generating part for generating torque fluctuations at the rotation shaft 1 of the torque absorber 100, but it is needless to say that the same effect can be obtained by using hydraulic pressure instead of air pressure or by using only the spring force without using air pressure as another example of this energizing force. Thus, the load generating means in the present invention is not limited to the means in the illustrated preferred embodiment.

Also, when pressure working on the piston 50 of the torque absorber 100 shown in the illustrated preferred embodiment is set so that it is raised according to the load on the engine 3, torque fluctuations of the engine that increased according to the load on the engine can be absorbed, which gives an excellent effect in that car body vibrations caused by torque fluctuations can be lowered not only in the idling state, but also at start or acceleration of the vehicle.

Also, in the illustrated preferred embodiment, operation of the torque absorber 100 by electric current in the solenoid 70 is controlled using the piston engaging means which can stop the reciprocating motion of the piston by the hook 71, but it may be so constituted that generation of the torque fluctuations is eliminated only by cutting off the high pressure from the air compressor without using such an engaging means, or the torque absorber 100 may be operated all the time during rotation of the engine depending on the case.

Also, for the rotation transmitting means, the toothed belt is used in the illustrated preferred embodiment, but a rotation transmitting means using gears may be used. And, as the illustrated preferred embodiment shows an example in which the present invention is applied to a four-cycle engine with four cylinders, the rotation transmitting means is so constituted that the pulley 10 of the torque absorber 100 makes two rotations for one rotation of the crank pulley 30 of the engine 3, but as a four-cycle engine with N cylinders has N/2 cycles of torque fluctuation in general, the effect of restraining torque fluctuations can be obtained by a rotation transmitting means in which the ratio of teeth of the pulleys is set so that the torque absorber makes N/2 rotations for one engine rotation.

Figure 6:
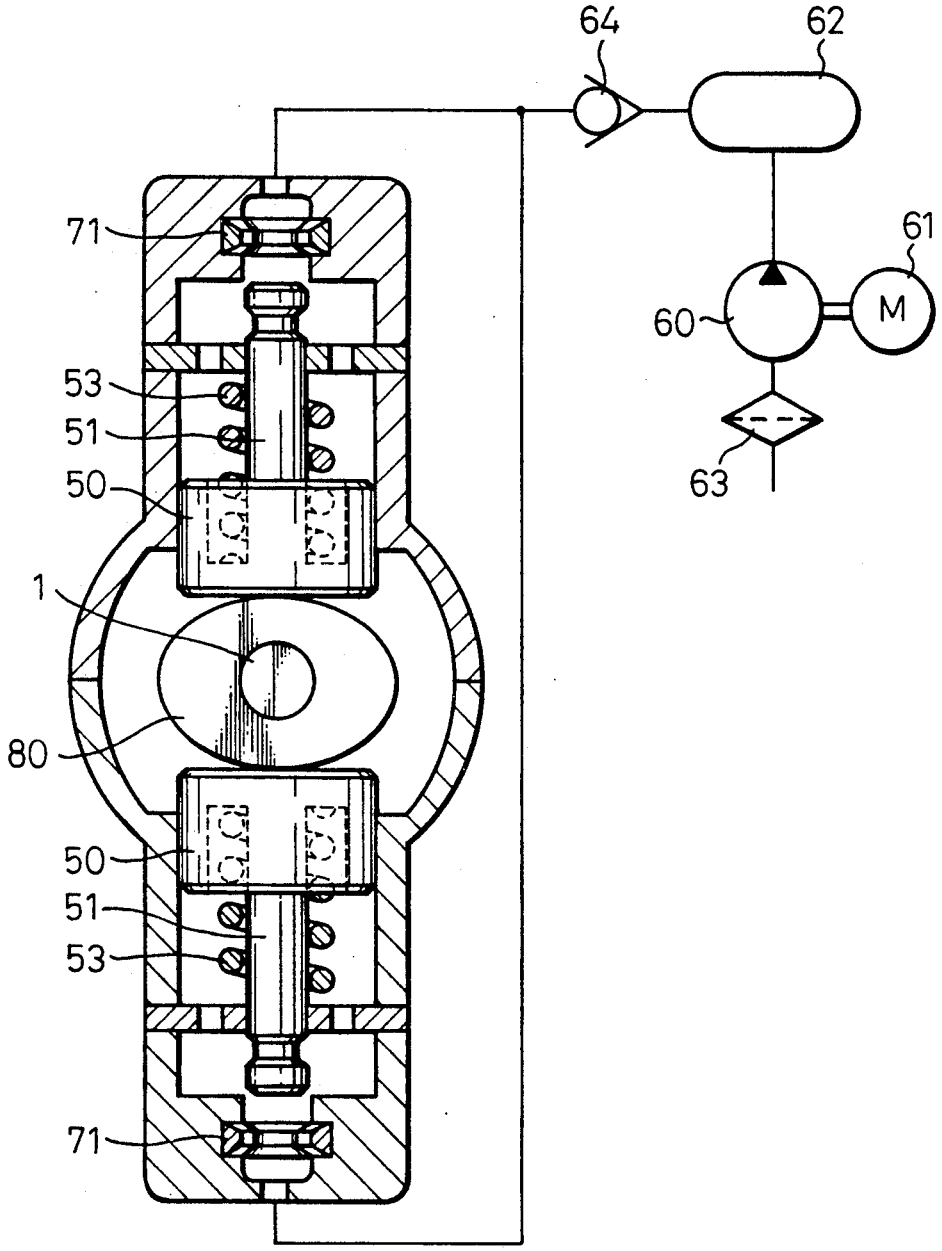
FIG. 6 is a vertical section showing another preferred embodiment of a torque absorber according to the present invention.

Moreover, the torque absorber of the illustrated preferred embodiment is so constituted that one cycle of torque fluctuation is given per rotation, but the same effect can be obtained by constituting the torque absorber so that it has M cycles of torque fluctuation per rotation and by setting the rotation ratio of the absorber pulley 10 to the crank pulley 30 to N/2:M. As a preferred embodiment, constitution of the torque absorber with M=2 is shown in FIG. 6.

In this preferred embodiment, a cam 80 almost elliptical in shape is integrally formed at the rotation shaft 1, and the piston 50 receives the force of the spring 53 and compressed air and is applied to the above cam 80 so as to constitute the load generating part. The cam 80 is formed so that the generated load changes in an almost sinusoidal wave pattern, whereby the piston 50 makes two reciprocating motions while the rotation shaft rotates once so as to generate two cycles of torque fluctuation in the almost sinusoidal wave. Moreover, as two pistons are provided at opposing positions in relation to the rotation shaft 1, vibrations caused by reciprocating motion of the piston 50 can be offset. Also, as the speed ratio of the crank pulley 30 to the absorber pulley 10 is 1:1, the diameter of the crank pulley 30 need not be increased as in the preferred embodiment shown in FIG. 1. In this preferred embodiment, it is needless to say that the same effect can be obtained even if an energizing force applied to the piston 50 is provided by another means as in the above mentioned preferred embodiment.

We claim:

1. A torque fluctuation absorbing device for an engine comprising:

a torque absorber mounted on an engine for generating torque fluctuations;

a rotation transmitting means for transmitting rotation of a crank shaft of said engine to a rotation shaft of said torque absorber without changing the synchronous relationship.

said crank shaft being connected to the rotation shaft of said torque absorber by said rotation transmitting means so that torque fluctuations are generated in an opposite phase to a phase of the torque fluctuations generated at said crank shaft; and said torque absorber is constituted by a crank mechanism for converting rotation of said rotation shaft to a reciprocating motion, a piston which has a reciprocating motion induced by said crank mechanism and a spring for applying a load to said piston.

2. A torque fluctuation absorbing device for an engine according to claim 1 wherein said rotation transmitting means is constituted by a toothed pulley integrally rotated with the crank shaft of said engine, a toothed pulley integrally rotated with the rotation shaft of said torque absorber and a toothed belt passed around these pulleys.

3. A torque fluctuation absorbing device for an engine according to claim 1 wherein said torque absorber is provided with a piston engaging means for holding said piston at a top dead center position.

4. A torque fluctuation absorbing device for an engine according to claim 3 wherein said piston engaging means is provided with a solenoid.

5. A torque fluctuation absorbing device for an engine according to claim 4 wherein said piston engaging means is provided with a hook operated by said solenoid.

6. A torque fluctuation absorbing device for an engine according to claim 4 wherein said solenoid is driven and controlled by a control circuit.

7. A torque fluctuation absorbing device for an engine according to claim 6 wherein said control circuit is constituted so that said solenoid is driven and controlled according to the speed of an engine.

8. A torque fluctuation absorbing device for an engine comprising:

a torque absorber mounted on an engine for generating torque fluctuations;

a rotation transmitting means for transmitting rotation of a crank shaft of said engine to a rotation shaft of said torque absorber without changing the synchronous relationship.

said crank shaft being connected to the rotation shaft of said torque absorber by said rotation transmitting means so that torque fluctuations are generated in an opposite phase to a phase of the torque fluctuations generated at said crank shaft; and said torque absorber is constituted by a crank mechanism for converting rotation of said rotation shaft to a reciprocating motion, a piston which has a reciprocating motion in a cylinder part induced by said crank mechanism and a fluid pressure supplying means for applying fluid pressure as a load to said piston.

9. A torque fluctuation absorbing device for an engine according to claim 8, wherein said rotation transmitting means is constituted by a first toothed pulley integrally rotated with the crank shaft of said engine, a second toothed pulley integrally rotated with the rotation shaft of said torque absorber and a toothed belt passed around said first and second toothed pulleys.

10. A torque fluctuation absorbing device for an engine according to claim 8 wherein said fluid pressure supplying means is constituted by a compressed air supplying means.

11. A torque fluctuation absorbing means for an engine according to claim 10 wherein said compressed air supplying means is provided with an air compressor driven by an electric motor controlled by a control circuit.

12. A torque fluctuation absorbing means for an engine according to claim 11 wherein said control circuit is constituted so that it controls driving of said electric motor according to the speed of said engine.

13. A torque fluctuation absorbing means according to claim 6 wherein said compressed air supplying means is provided with an air compressor driven by an electric motor controlled by a control circuit and an accumulator for accumulating air compressed by said air compressor.

14. A torque fluctuation absorbing means for an engine according to claim 13 wherein said control circuit is constituted so that driving of said electric motor is controlled according to pressure of compressed air detected by a pressure sensor provided at said accumulator.

15. A torque fluctuation absorbing device for an engine according to claim 13 wherein said control circuit is constituted so that driving of said electric motor is controlled according both to the speed of an engine and pressure of compressed air detected by a pressure sensor provided at said accumulator.

* * * * *